US009181734B2

(12) United States Patent
Minemura

(10) Patent No.: US 9,181,734 B2
(45) Date of Patent: Nov. 10, 2015

(54) VEHICLE DOOR HANDLE DEVICE

(75) Inventor: Ryuji Minemura, Kanagawa (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 27 days.

(21) Appl. No.: 13/821,673

(22) PCT Filed: Oct. 14, 2011

(86) PCT No.: PCT/JP2011/073728

§ 371 (c)(1),
(2), (4) Date: Mar. 8, 2013

(87) PCT Pub. No.: WO2012/050212

PCT Pub. Date: Apr. 19, 2012

(65) Prior Publication Data

US 2013/0168979 A1 Jul. 4, 2013

(30) Foreign Application Priority Data

Oct. 15, 2010 (JP) ..... 2010-232703

(51) Int. Cl.

| | |
|---|---|
| ***E05B 3/00*** | (2006.01) |
| ***E05B 85/12*** | (2014.01) |
| ***E05B 79/20*** | (2014.01) |
| *E05B 77/38* | (2014.01) |

(52) U.S. Cl.

CPC ..... *E05B 85/12* (2013.01); *E05B 79/20* (2013.01); *E05B 85/13* (2013.01); *E05B 77/38* (2013.01); *Y10T 292/57* (2015.04)

(58) Field of Classification Search

CPC ..... E05B 77/36; E05B 77/38; E05B 79/20; E05B 85/12; E05B 85/13; Y10T 292/57; Y10S 292/23

USPC ..... 292/336.3, DIG. 22, 1

See application file for complete search history.

(56) References Cited

U.S. PATENT DOCUMENTS

| | | | | | |
|---|---|---|---|---|---|
| 3,606,428 | A | * | 9/1971 | Erck et al. | 292/336.3 |
| 4,374,597 | A | | 2/1983 | Mochida | |
| 4,580,822 | A | * | 4/1986 | Fukumoto | 292/336.3 |
| 4,778,207 | A | * | 10/1988 | Gergoe | 292/336.3 |
| 4,838,590 | A | * | 6/1989 | Isomura | 292/336.3 |
| 4,993,763 | A | * | 2/1991 | Tanimoto et al. | 292/336.3 |
| 5,011,202 | A | * | 4/1991 | Kato et al. | 292/336.3 |

(Continued)

FOREIGN PATENT DOCUMENTS

| | | | |
|---|---|---|---|
| CN | Y-201401069 | | 2/2010 |
| JP | 6-79975 | | 11/1994 |
| JP | A-H11-107606 | | 4/1999 |
| JP | A-2003-193706 | | 7/2003 |
| JP | 2007009479 | A * | 1/2007 |
| JP | 2009-133136 | | 6/2009 |

*Primary Examiner* — Kristina Fulton
*Assistant Examiner* — Christine M Mills
(74) *Attorney, Agent, or Firm* — Drinker Biddle & Reath LLP

(57) ABSTRACT

In a vehicle door handle device, an operating member is pivotally supported to a handle base. A door lock device is operated via an operating force transmitting part by a rotation of the operating member from an initial position to an operating position. A connection-retaining member attached to the operating member retains a connection of one end of the operating force transmitting part to the operating member and abuts against a stopper wall surface of the handle base so as to define an operating stroke end position of the operating member. A second stopper is provided on the operating member and abuts against the handle base in an over-stroke position beyond the operating stroke end position.

7 Claims, 6 Drawing Sheets

(56) References Cited

U.S. PATENT DOCUMENTS

| | | | | |
|---|---|---|---|---|
| 5,129,694 | A * | 7/1992 | Tanimoto et al. | 292/347 |
| 5,794,994 | A * | 8/1998 | Miyagawa et al. | 292/336.3 |
| 5,895,081 | A * | 4/1999 | Tanimoto et al. | 292/348 |
| 6,363,577 | B1 * | 4/2002 | Spitzley | 292/336.3 |
| 6,964,438 | B2 * | 11/2005 | Koike et al. | 292/201 |
| 6,976,717 | B2 * | 12/2005 | Barr et al. | 292/336.3 |
| 6,988,752 | B2 * | 1/2006 | Belchine et al. | 292/336.3 |
| 8,408,611 | B2 * | 4/2013 | Takagai et al. | 292/336.3 |
| 8,727,401 | B2 * | 5/2014 | Tanaka et al. | 292/336.3 |
| 2008/0073919 | A1 * | 3/2008 | Soda | 292/336.3 |
| 2008/0105011 | A1 * | 5/2008 | Machida et al. | 70/237 |
| 2009/0267359 | A1 * | 10/2009 | Takayanagi et al. | 292/201 |

* cited by examiner

VEHICLE DOOR HANDLE DEVICE

TECHNICAL FIELD

The present invention relates to a door handle device for a vehicle.

BACKGROUND ART

FIG. 4 of Patent Document 1 discloses a door handle device which prevents an impact noise in a stroke end position of an operating member connected to a handle base. According to the structure of Patent Document 1, in the handle device, a locking/unlocking operation knob (operating member) is rotatably connected to a main body (handle base) and an operation of the operating member is transmitted to a door lock device via a rod.

To a holder member attached to the operating member in order to connect the rod to the operating member, a buffering part is integrally formed. The buffering part abuts against a stopper part provided in the handle base when the operating member is moved to the stroke end position. Accordingly, an impact noise is prevented from occurring when the operating member is moved to the stroke end position.

PRIOR ART DOCUMENT

Patent Document

Patent Document 1: JP-U-06-079975

However, in the structure disclosed in Patent Document 1, the holder member is formed from a soft material in order to give a buffering effect and a large impact load is repeatedly applied to the holder member. Further, the holder member is normally subjected to a static load in the stroke end position. Accordingly, there is a problem that the elasticity ability of the holder member is lost over time and thus the buffering effect of the holder member is disappeared.

SUMMARY OF INVENTION

Embodiments of the present invention provide a vehicle door handle device which is capable of preventing an occurrence of buffering noise over a long period of time with a simple structure.

According to an embodiment of the present invention, a vehicle door handle device may include: a handle base 1; an operating member 2 which is pivotally supported to the handle base 1, a door lock device 4 being operated via an operating force transmitting part 3 by a rotation of the operating member 2 from an initial position to an operating position; a connection-retaining member 6 which is formed from a synthetic resin material softer than the operating member 2, is attached to the is operating member 2, and in its attached state, retains a connection of one end of the operating force transmitting part 3 to the operating member 2 and abuts against a stopper wall surface 5 of the handle base 1 so as to define an operating stroke end position of the operating member 2; and a second stopper 7 which is provided on the operating member 2 and abuts against the handle base 1 in an over-stroke position beyond the operating stroke end position defined by the connection-retaining member 6 so as to restrict a deformation of the connection-retaining member 6 by an over-stroke.

BRIEF DESCRIPTION OF DRAWINGS

FIG. 2 (*b*) is a sectional view taken along a line 2B-2B in FIG. 1.

FIG. 3 (*b*) is a sectional view taken along a line 3B-3B in FIG. 1.

FIG. 4 (*b*) is a perspective view of the locking lever as seen from the opposite direction of FIG. 4 (*a*).

FIG. 5 (*b*) is a view showing a cable device.

FIG. 6 (*b*) is an enlarged view showing a main part of FIG. 6 (*a*). FIG. 6 (*c*) is a view showing an unlocked position. FIG. 6 (*d*) is a view showing a second stopper in an over-stroke position.

DESCRIPTION OF EMBODIMENTS

Hereinafter, an exemplary embodiment will be described with reference to the drawings. The exemplary embodiment is illustrative and not intended to limit the present invention. It should be noted that all features and combinations of the features described in the exemplary embodiment are not necessarily essential to the invention.

Figure 1:
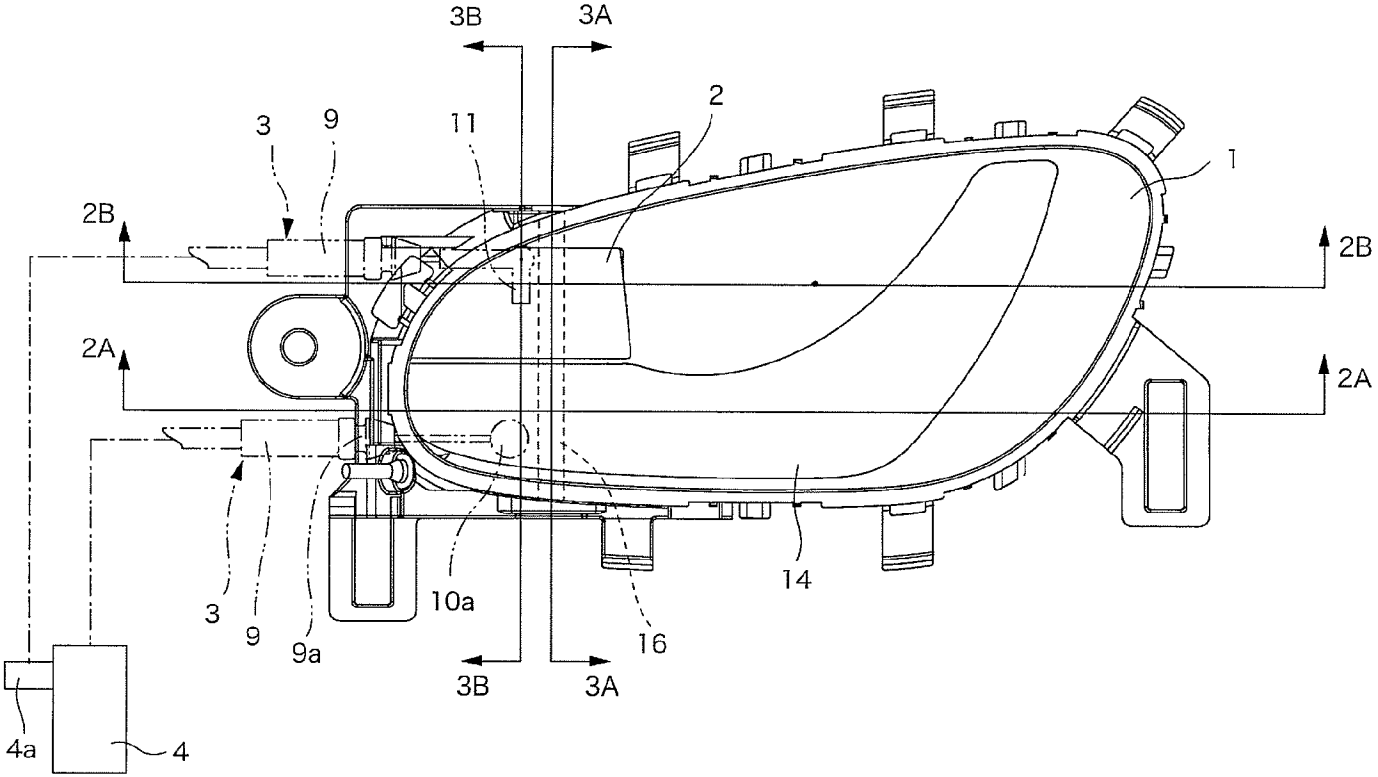
FIG. 1 is a front view showing a vehicle door handle device according to an exemplary embodiment.

FIG. 1 shows a door handle device of the exemplary embodiment configured as a door-inside-handle device for a vehicle. In the door-inside-handle device, an operating handle 14 and a locking lever (operating member 2) are pivotally supported to a handle base 1 by using a pivot shaft 16. The handle base is fixed to a door panel (not shown).

A cable device (an operating force transmitting part 3) in which an inner cable 10 is slidably inserted into an outer case is connected to the operating handle 14 and the locking lever 2. As will be described later, when the operating handle 14 is operated to rotate from an initial position to an operating position, locking of a door lock device 4 is released and thus an opening operation of a door body can be performed. As the locking lever 2 is operated to rotate from an unlocked position to a locked position, a cancellation part 4*a* is operated to cancel the operation form the operating handle 14. Accordingly, the opening operation of the door body by the operating handle 14 becomes impossible.

Figure 2A:
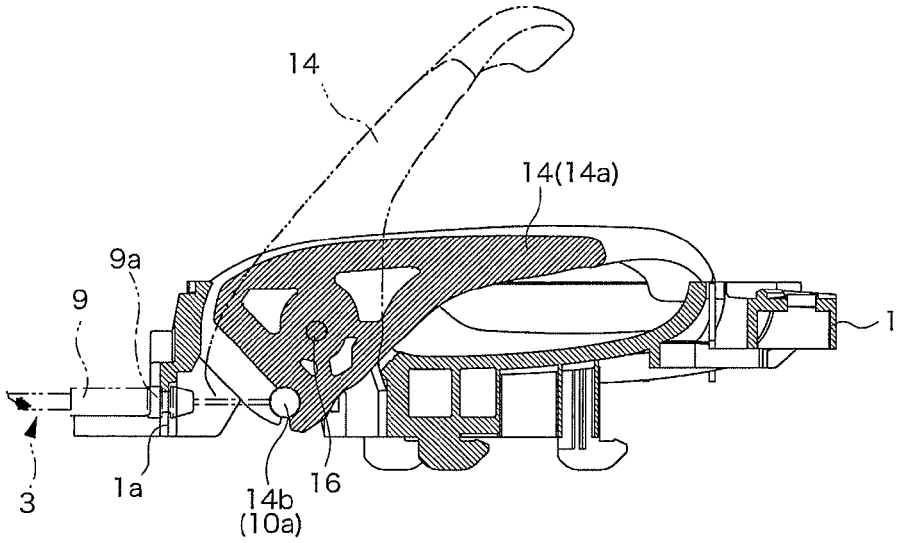
FIG. 2 (*a*) is a sectional view taken along a line 2A-2A in FIG. 1.
Figure 2B:
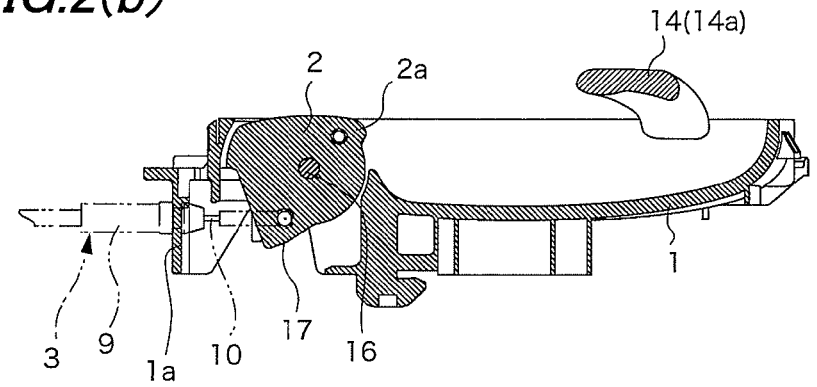
Figure 3A:
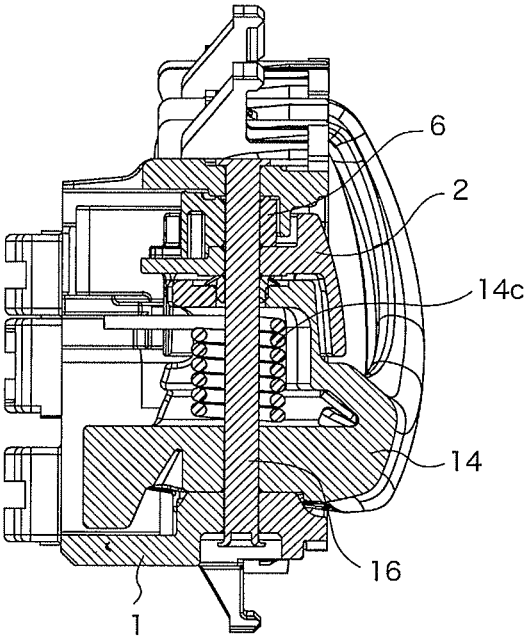
FIG. 3 (*a*) is a sectional view taken along a line 3A-3A in FIG. 1.
Figure 3B:
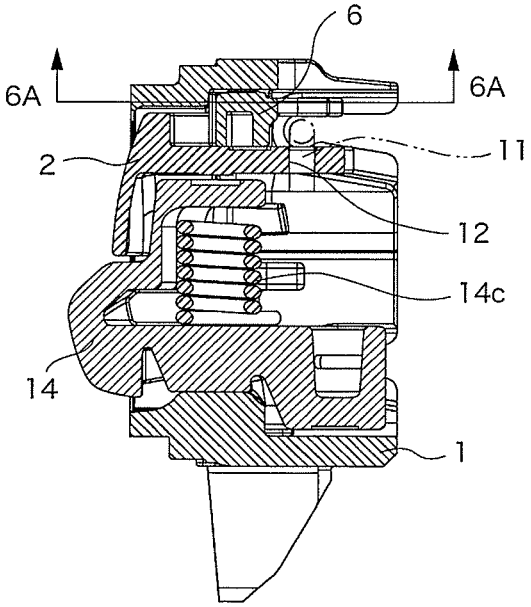

The operating handle 14 includes a hand-grip part 14*a* at one end and a wire connection hole 14*b* at the other end with the center of rotation being therebetween. The operating handle is operated to rotate around the pivot shaft 16 between an initial position indicated by a solid line in FIG. 2 (*a*) and an operating position indicated by a dashed line in FIG. 2 (*a*). As shown in FIG. 3 (*a*), an urging force toward the initial position is applied to the operating handle 14 by a torsion spring 14*c*.

Mounting of the cable device 3 corresponding to the operating handle 14 is carried out by locking a case end 9*a* formed on an end of the outer case 9 with a cable locking part 1*a* formed on the handle base 1 and fitting a spherical cable end 10*a* fixed to a leading end of the inner cable 10 into the wire connection hole 14*b* of the operating handle 14.

Meanwhile, the locking lever 2 is formed by injection molding a synthetic resin material. The locking lever 2 includes an operation protruding part 2*a* at an external exposed surface when being mounted on the handle base 1 and a cable insertion hole 12 at an opposite end with the pivot shaft 16 being therebetween.

Figure 5A:
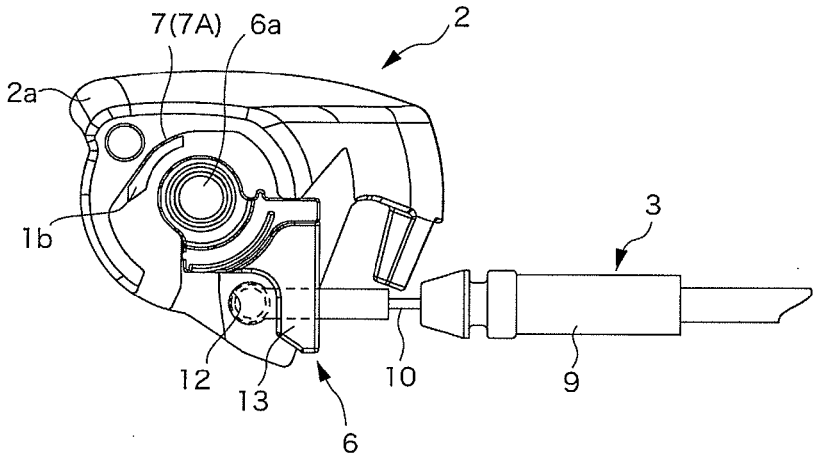
FIG. 5 (*a*) is a view showing a state where an inner cable is connected to the locking lever.
Figure 5B:
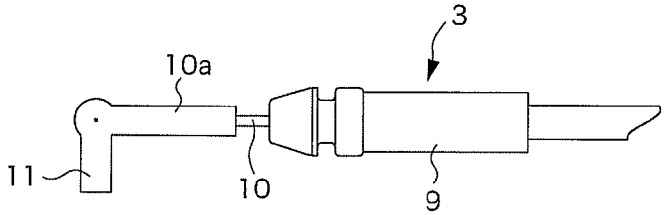
Figure 6A:
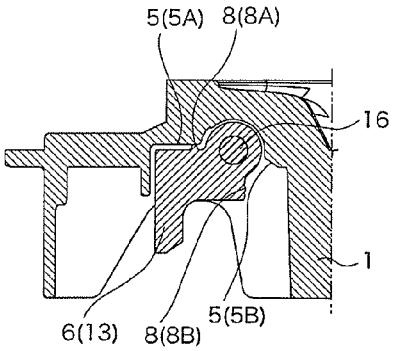
FIG. 6 (*a*) is a sectional view taken along a line 6A-6A in FIG. 3 (*b*), showing a locked position of the stroke of the locking lever.
Figure 6B:
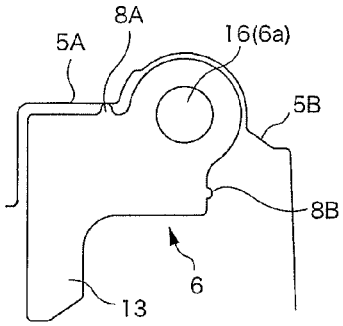
Figure 6C:
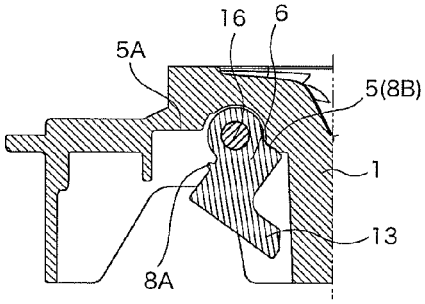
Figure 6D:
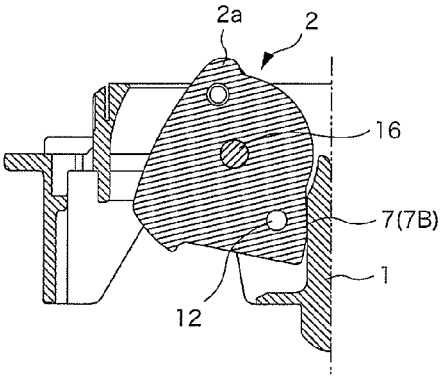

As shown in FIG. 5 (*b*), the cable end 10*a* having L-shaped bent tip is fixed to the inner cable 10 of the cable device 3 corresponding to the locking lever 2. The inner cable 10 is connected to the locking lever 2 by inserting a connection-bent part 11 into the cable insertion hole 12.

In order to prevent detachment of the inner cable 10 from the cable insertion hole 12, the connection-retaining member 6 is connected to the locking lever 2. The connection-retaining member 6 is formed from a synthetic resin material softer than the locking lever 2. The connection-retaining member 6 is mounted to idle freely around the pivot shaft 16 by inserting the pivot shaft 16 to pivotally support the locking lever 2 into a shaft insertion hole 6*a*.

Figure 4A:
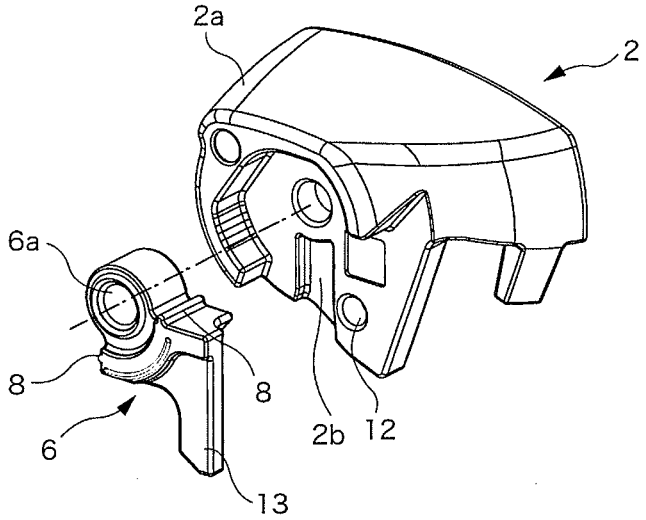
FIG. 4 (*a*) is a perspective view of a locking lever as seen from a mounting side of a connection-retaining member.
Figure 4B:
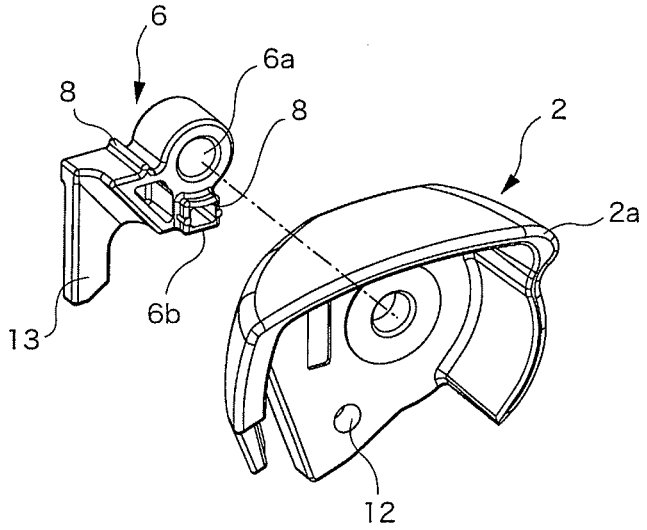

As shown in FIG. 4 (*b*), the connection-retaining member 6 is provided with a detent protrusion 6*b* and a wing part 13. The detent protrusion 6*b* is formed to protrude from a wall surface of the connection-retaining member 6. The idling of the connection-retaining member 6 to the locking lever 2 is restricted by fitting the detent protrusion 6*b* into a fitting recess 2*b* formed on the wall surface of the locking lever 2. In this way, the connection-retaining member 6 is rotated together with the locking lever 2.

Further, as shown in FIG. 5 (*a*), in the mounted state, the wing part 13 cooperates with the locking lever 2 to hold the cable end 10*a* of the inner cable 10 therebetween and restricts movement of the connection-bent part 11 in a direction (a front side direction in FIG. 5) detached from the cable insertion hole 12, thereby maintaining the connected state of the inner cable 10.

Further, the connection-retaining member 6 is provided with two stopper ridges 8 in corresponding to the locked position and the unlocked position. As shown in FIG. 6 (*a*), when the locking lever 2 is in the locked position, a lock-side stopper ridge 8A of the connection-retaining member 6 abuts against a lock-side stopper wall 5A formed on the handle base 1 to define a lock-side stroke end of the locking lever 2.

As the locking lever 2 is operated to rotate toward the unlocked position from this state, an unlock-side stopper ridge 8B abuts against an unlock-side stopper wall surface 5B of the handle base 1 to define an unlock-side stroke end, as shown in FIG. 6 (*c*).

Further, the locking lever 2 is provided with a second stopper 7. In the exemplary embodiment, a lock-side second stopper 7A abuts against the stopper protrusion 1*b* protruding from the handle base 1, as shown in FIG. 5 (*a*), and an unlock-side second stopper 7B is formed on an outer peripheral wall of the locking lever 2, as shown in FIG. 6(*c*).

When load in an over-stroke direction is further applied after the locking lever 2 reaches the stroke end position by abutting against the stopper ridge 8 of the connection-retaining member 6, that is, an operating force in a direction of the locked position is further applied after an operation toward the locked position is ended, or when an operating force in a direction of the unlocked position is further applied after an operation toward the unlocked position is ended and thus the stopper ridge 8 is deflected by the load in a pushing direction and a protruding state thereof is released, these second stoppers 7 are operated to prevent further deflection of the connection-retaining member 6.

Accordingly, in the exemplary embodiment, the stopper ridge 8 of the connection-retaining member 6 first abuts against the stopper wall surface 5 of the handle base 1 when the locking lever 2 is electrically or manually operated from one position to the other position, that is, from the locked position to the unlocked position or from the unlocked position to the locked position. Even when the movement from one position to the other position is carried out by a large driving force as in an electric operation, an impact noise is prevented from occurring since a soft stopper ridge 8 is first collided with and brought into contact with the stopper wall surface of the handle base.

In this state, when an operating force in the same direction as the movement is further applied to the locking lever 2 as shown in FIG. 6(*d*), the second stopper 7 abuts the connection-retaining member and thus prevents loss of elasticity or the like due to excessive deflection of the connection-retaining member 6.

As described above, according to the exemplary embodiment, the door handle device may include the operating member 2 (the locking lever 2) pivotally supported to the handle base 1, the second stopper 7 formed on the operating member 2 and the connection-retaining member 6 formed from a synthetic resin material softer than the operating member 2.

The operating member 2 is able to rotate between the initial position and the operating position. When the operating member is operated to rotate from the initial position to the operating position, the door lock device 4 is operated via the operating force transmitting part 3 connected to the operating member 2. The operating member 2 may be driven by a manual operation or an electric drive means such as a motor. Further, either the manual operation or the electric drive means can be selectively used depending on the situation. Further, as the operating force transmitting part 3, the cable device 3 in which the inner cable 10 is slidably inserted into the outer case 9, or a rod or the like may be used.

The connection-retaining member 6 may be a so-called known rod holder or the like which is intended to retain the connected state of the operating member 2 and the operating force transmitting part 3 in a state where the rod holder is mounted to the operating member 2 and used in a state of being connected to one end of the operating force transmitting part 3 by a suitable connecting means. Alternatively, the connection-retaining member 6 may indirectly restrict the movement direction and the movement amount of the operating force transmitting part 3 to prevent the detachment of the operating force transmitting part from the operating member 2, instead of being directly connected to the operating force transmitting part 3.

In addition, the connection-retaining member 6 also serves as a stroke restricting member. The stroke end position of the operating member 2 is defined by abutting the connection-retaining member 6 against the stopper wall surface 5 formed on the handle base 1. Since the soft connection-retaining member 6 is used to define the stroke end, an impact noise is prevented from occurring in the stroke end position.

The second stopper 7 abuts against the handle base 1 in an over-stroke position from the stroke end position defined by the connection-retaining member 6 to restrict the deformation amount of the connection-retaining member 6 due to the over-stroke. As a result, it is possible to prevent performance degradation of the connection-retaining member 6 due to decrease in elasticity ability.

Further, the connection-retaining member 6 may be mounted to the rotation shaft of the operating member 2. With this configuration, it is possible to reliably prevent the connection-retaining member 6 from being detached from the operating member 2.

Furthermore, the door handle device may be configured as a door-inside-handle device and the operating handle 14 may be connected to the handle base 14.

According to the structure of the exemplary embodiment, since the deflection of the connection-retaining member is limited by the second stopper, it is possible to prevent the occurrence of buffering noise over a long period of time.

DESCRIPTION OF REFERENCE NUMERALS

1 HANDLE BASE
2 OPERATING MEMBER
3 OPERATING FORCE TRANSMITTING PART
4 DOOR LOCK DEVICE
5 STOPPER WALL SURFACE
6 CONNECTION-RETAINING MEMBER
7 SECOND STOPPER
8 STOPPER RIDGE
9 OUTER CASE
10 INNER CABLE
11 CONNECTION-BENT PART
12 CABLE INSERTION HOLE
13 WING PART
14 OPERATING HANDLE

The invention claimed is:

1. A vehicle door handle device comprising:

a handle base;

an operating member which is pivotally supported to the handle base, a door lock device being operated via an operating force transmitting part by a rotation of the operating member from an initial position to an operating position;

a connection-retaining member which is formed from a synthetic resin material softer than the operating member, is attached to the operating member, and in an attached state, retains a connection of one end of the operating force transmitting part to the operating member and abuts against a stopper wall surface of the handle base so as to define an operating stroke end position of the operating member; and a second stopper which is provided on the operating member and abuts against the handle base only in an overstroke position in which the operating member rotates beyond the operating stroke end position defined by the connection-retaining member so as to restrict a deformation of the connection-retaining member by an overstroke.

2. The vehicle door handle device according to claim 1, wherein the connection-retaining member is formed with a stopper ridge, and wherein the operating stroke end position is defined by a contact of the stopper ridge and the stopper wall surface of the handle base.

3. The vehicle door handle device according to claim 1, wherein the operating force transmitting part includes a cable device in which an inner cable is slidably inserted into an outer case, wherein the operating member and the inner cable are connected to each other by inserting a connection-bent part into a cable insertion hole of the operating member, the connection-bent part being formed on a leading end of the inner cable and perpendicular to a longitudinal direction of the inner cable, and wherein the connection-retaining member includes a wing part which retains a connected state of the operating member and the inner cable by restricting the movement of the connection-bent part in a direction detached from the cable insertion hole.

4. The vehicle door handle device according to claim 3, wherein the connection-retaining member is attached to a rotation shaft of the operating member, and wherein, in the attached state, the connection-retaining member is connected to the operating member in a rotation direction and is rotatable together with the operating member.

5. The vehicle door handle device according to claim 1, wherein the connection-retaining member is attached to a rotation shaft of the operating member, and wherein, in the attached state, the connection-retaining member is connected to the operating member in a rotation direction and is rotatable together with the operating member.

6. The vehicle door handle device according to claim 1, wherein the door handle device is a door-inside-handle device, wherein an operation handle is connected to the handle base, and wherein the operating member is a locking lever.

7. The vehicle door handle device according to claim 1, wherein a stopper ridge of the connection-retaining member is adapted to contact with the handle base at the operating stroke end position, and the second stopper is adapted to contact with the handle base when an operating force is further applied from the operating stroke end position.

* * * * *